US009399544B2

(12) United States Patent
Dhaenens et al.

(10) Patent No.: US 9,399,544 B2
(45) Date of Patent: Jul. 26, 2016

(54) VALVE FOR AN AEROSOL CONTAINER

(75) Inventors: Herman Dhaenens, Deinze (BE); Jordi Demey, Deinze (BE); Koen Claerbout, Deinze (BE); Matthias Alderweireldt, Deinze (BE)

(73) Assignee: Altachem NV, Deinze (BE)

( * ) Notice: Subject to any disclaimer, the term of this patent is extended or adjusted under 35 U.S.C. 154(b) by 44 days.

(21) Appl. No.: 13/981,086

(22) PCT Filed: Jan. 20, 2012

(86) PCT No.: PCT/EP2012/050897
§ 371 (c)(1),
(2), (4) Date: Oct. 30, 2013

(87) PCT Pub. No.: WO2012/101061
PCT Pub. Date: Aug. 2, 2012

(65) Prior Publication Data

US 2014/0048567 A1 Feb. 20, 2014

(30) Foreign Application Priority Data

Jan. 27, 2011 (EP) ..... 11152417

(51) Int. Cl.
*B65D 83/00* (2006.01)
*B65D 83/46* (2006.01)
*B65D 83/48* (2006.01)
*B65D 83/38* (2006.01)

(52) U.S. Cl.
CPC ..... *B65D 83/46* (2013.01); *B65D 83/38* (2013.01); *B65D 83/48* (2013.01)

(58) Field of Classification Search
CPC ..... B65D 83/46; B65D 83/50; B65D 83/384; B65D 83/386; B65D 83/752
USPC ..... 222/402.1, 402.2, 402.21, 402.22, 222/402.23, 402.24; 251/149.8, 349
See application file for complete search history.

(56) References Cited

U.S. PATENT DOCUMENTS 2,829,806 A * 4/1958 Tedaldi ..... B65D 83/46 222/402.22
2,965,270 A * 12/1960 Soffer ..... B65D 83/46 222/402.22
3,018,928 A * 1/1962 Meshberg ..... B65D 83/425 222/335

(Continued)

FOREIGN PATENT DOCUMENTS

DE 1 037 377 8/1958
EP 0 102 797 3/1984

(Continued)

*Primary Examiner* — J. Casimer Jacyna
*Assistant Examiner* — Benjamin R Shaw
(74) *Attorney, Agent, or Firm* — Levy & Grandinetti

(57) ABSTRACT

A valve for dispensing moisture reactive liquids is disclosed. The valve has a valve cup for tightly closing a container including a through opening, and a first annular fold forming a groove in a first, inner surface and a rib in a second, outer surface. The valve includes a resilient grommet and a valve stem. The valve stem includes a hollow tubular portion, defining a central bore snugly fitting in the grommet central bore and extending on both sides of the grommet with a first end opening to ambient and a second, opposite end being closed by a circular end base greater than the diameter of the bore of the grommet. The upper surface of the flange portion of the grommet mates with the first, inner surface of the cup including the portion of the grommet mating the groove formed by the fold.

20 Claims, 3 Drawing Sheets

(56) References Cited

U.S. PATENT DOCUMENTS

| | | | | | |
|---|---|---|---|---|---|
| 3,132,774 | A * | 5/1964 | Soffer | B65D 83/46 | 222/402.22 |
| 4,765,516 | A * | 8/1988 | Metcoff | B65D 83/46 | 222/402.22 |
| 4,824,075 | A * | 4/1989 | Holzboog | B65D 83/46 | 222/402.22 |
| 5,014,887 | A | 5/1991 | Kopp | | |
| 5,762,319 | A * | 6/1998 | Kopp | F16K 27/0245 | 251/149.6 |
| 6,425,503 | B1 * | 7/2002 | Scheindel | B65D 83/46 | 222/402.15 |
| 8,371,481 | B2 | 2/2013 | Kopp | | |
| 2001/0027982 | A1 * | 10/2001 | Lilienthal | B05C 17/015 | 222/389 |
| 2003/0080158 | A1 * | 5/2003 | Cull | B65D 83/70 | 222/397 |
| 2005/0077494 | A1 * | 4/2005 | Marroncles | B65D 83/46 | 251/331 |
| 2006/0065678 | A1 * | 3/2006 | McBroom | B65D 83/14 | 222/402.1 |
| 2007/0215650 | A1 * | 9/2007 | De Schrijver | B65D 83/46 | 222/402.21 |
| 2009/0078902 | A1 * | 3/2009 | Flynn | B65D 83/46 | 251/149.8 |

FOREIGN PATENT DOCUMENTS

| | | |
|---|---|---|
| WO | WO 96/17795 | 6/1996 |
| WO | WO 2006/032061 | 3/2006 |
| WO | WO 2009/042206 | 4/2009 |

* cited by examiner (a)

(b)

VALVE FOR AN AEROSOL CONTAINER

This Application is the U.S. National Phase of International Application Number PCT/EP2012/050897 filed on Jan. 20, 2012, which claims priority to European Application Number 11152417.9 filed on Jan. 27, 2011.

TECHNICAL FIELD

The present invention relates to aerosol valves of the type operated to dispense moisture reactive composition in aerosol form, such as polyurethane foams. In particular, the present invention relates to an aerosol valve design which allows savings in terms of cup thickness whilst ensuring excellent stability of the valve as a whole and, in particular of the grommet, tightness, and reliability.

BACKGROUND FOR THE INVENTION

Typically, aerosol valves for dispensing a moisture reactive composition in aerosol form such as a polyurethane foam are fixed to a pressurized can by a cup closing the top opening by means of a peripheral annular channel encasing a peripheral can bead defining the perimeter of the can top opening. The cup comprises a central bore through which a tubular resilient grommet extends both above and below the cup (the expressions "below" and "above" the cup refer herein to facing inside and outside the can, respectively). The grommet is roughly a hollow cylindrical tube which central bore opens at both ends and which comprises at its end located below the cup a substantially annular flange radially extending outwards and which upper surface contacts the lower (inner) surface of the cup and is suitable for sealing against the latter.

A rigid valve stem is engaged snugly in the central bore of the grommet extending both below and above said grommet and is held in place by appropriate means (generally annular flanges sandwiching the upper and lower portions of the grommet). The valve stem is formed by a hollow tube closed at a first end by an annular base forming a flange of diameter greater than the one of the inner bore of the grommet and which upper surface of the base flange is suitable for sealing against the lower surface of the grommet flange. The lateral wall of the tubular portion of the stem generally comprise openings bringing in fluid communication the inner bore of the stem with the interface between the stem base and the grommet flange.

By tilting the portion of the valve stem extending out of the grommet the sealing interface between the grommet flange and the valve base is disrupted thus bringing in fluid communication the inner bore of the valve stem with the composition contained in the can. Since the can is pressurized, the content of the can is dispensed through the valve. When closed, the valve must ensure that no moisture from the outside contacts the content of the can, if the composition is reactive to moisture. Examples of valve designs suitable for dispensing a pressurized composition reactive to moisture, such as a polyurethane foam can be found in WO2006/032061, U.S. Pat. No. 6,425,503, U.S. Pat. No. 4,765,516, EP0.102.797, WO2009/042206, WO96/17795.

This type of cans and valve systems is for example, widely used for polyurethane foam compositions, They are generally sold in rather small format, typically 1 liter cans or less and are disposable. This means that the cost ratio between container (=can) and content (=PU foam) is quite critical and any improvement towards a reduction of the former is beneficial to both consumers and foam producers, provided the reliability of the valve is maintained. This can be achieved by reducing the thickness of the can walls, in particular the cup thickness, but since the cans are pressurized, this solution is rather limited for obvious mechanical reasons. Furthermore, the tightness of the contact surface, on the one hand, between the upper surface of the grommet flange and the lower surface of the cup and, on the other hand, between the lower surface of the grommet flange and the upper surface of the valve stem base are critical to prevent any leak either of composition leaking out of the container or moisture leaking into the container. Moisture can penetrate into the can in particular during use of the can as the valve is being tilted because, in case the grommet is not stable enough, the seal between the grommet flange and the cup bottom surface can be momentarily disrupted. Furthermore, after a few tilting of the valve, some crazes may form in the grommet where it contacts the edge of the cup bore.

The moisture problem is addressed in U.S. Pat. No. 4,765,516, wherein the cup comprises an annular rib of radius less than the grommet flange radius, thus forming with the latter an annular channel in which any moisture that would have leaked through the interface between the cup bore and the tubular portion of the grommet would accumulate and be trapped in said channel.

In EP0.102.797, the stability of the grommet is ensured by giving the cup and grommet flange maching frustoconical geometries, which ensures a tight contact between at least part of the two surfaces even during use.

WO2009/042206 proposes to sandwich the flange of the rubbery grommet between the cup on its upper side, and a second metallic washer extending all the way from the top edge of the can to the upper surface of the base of the valve stem. This guarantees, beside an optimal stability of the grommet, that no moisture can diffuse through the material of the grommet. This solution is certainly very efficient to preserve the content of the can from moisture, but the cost of the can is rather high for a commodity product sold in such small containers/

WO96/17795 solves the problem of tightness between grommet and cup by injection moulding the grommet such as to embed a portion of the bore.

U.S. Pat. No. 5,762,319, US2010/147897, and U.S. Pat. No. 5,014,887 each discloses a valve cup comprising a substantially planar central portion joined to an intermediate peripheral rim by a substantially vertical wall, said substantially vertical first wall being provided with a fold extending over a substantial portion of the wall circumference. The intermediate peripheral rim is joined to a peripheral edge suitable for sealingly fixing the cup to the top opening of a container by a substantially vertical second wall. A grommet is coupled to the cup as follows.

A central hollow tubular portion of the grommet snugly fitting through a central bore located in the central portion of the cup, whilst a base portion of the grommet extends radially over the inner surface of the substantially planar central portion. A substantially vertical peripheral wall extends from the base of the grommet to mate the geometry of the substantially vertical first wall of the cup, with a groove mating the fold in said wall. This geometry ensure a good contact with between the grommet and the cup, but it has a number of drawbacks.

First, it is expensive because much material is needed to form the grommet base, as well as the cup. For pressure containers produced at a scale of several millions units per annum, any unnecessary waste of materials can cost a lot of money. Second, the geometry of the cup is very intrusive into the container, as it comprises two levels with two substantially vertical walls. It follows that for a same capacity, headspace comprised, a container comprising such bulky cups must be slightly larger than a container with a smaller cup design. Here again, a small waste of material multiplied by the production volume can results in high unnecessary production costs. Finally, because of the intricate interlocking of the grommet groove and the cup fold, both located on vertical walls, they cannot be assembled but, on the contrary, the grommet must necessarily be injected over the cup. Reducing the choice of processes for the production of such high volume item is necessarily a drawback for the user.

It can be seen that, although numerous solutions have been proposed to optimize aerosol valves suitable for dispensing polyurethane foams, there remains much to do to reduce the production cost and ensure at the same time an optimal stability and reliability of the valve. This and other problems are solved by the present invention as is described in continuation.

SUMMARY OF THE INVENTION

The present invention is defined in the appended independent claims. Preferred embodiments are defined in the dependent claims. In particular, the present invention concerns valve for a pressurised dispensing container suitable for dispensing a polyurethane foam, comprising:

(a) A valve cup comprising a substantially planar central portion, and a peripheral edge suitable for sealingly fixing the cup to the top opening of a container and thus tightly closing the container, said cup being made of a thin plate comprising a first, inner surface and a second, outer surface, wherein the central portion comprises a through opening surrounded by a first annular fold of diameter, D, forming a groove in the first, inner surface (3in) and a rib in the second, outer surface of the substantially planar central portion;

(b) A resilient grommet extending on both sides of the cup through the cup opening, said grommet having a hollow tubular portion defining a central bore, and at a first end facing the interior of the container it comprises an annular flange portion of diameter greater than D, which upper surface seals against the first, inner surface of the cup's substantially planar central portion, (c) A valve stem comprising a hollow tubular portion defining a central bore, said valve stem snugly fitting in the grommet central bore, and extending on both sides of the grommet, with a first end opening to ambient and a second, opposite end being closed by a circular end base of diameter greater than the diameter of the bore of the grommet, wherein the upper surface of the base is suitable for sealing against the lower surface of the grommet flange.

The expression "thin plate" refers here as a plate which thickness is much smaller than any dimension in the other directions, i.e., at least one order of magnitude (10×), preferably two orders of magnitude (100×) smaller than any dimension in the main first, inner and second, outer surfaces.

The cup geometry comprising an annular fold and mating grommet yield a double advantage: first, the annular fold forms a stiffening rib which strengthens the cup structure, so that lower grade metals or thinner plates can be used; second, the grommet mating the fold geometry at the inner surface of the cup stabilizes the grommet. Furthermore, in particular for tilting valves, the valve stem base tends to slip on the lower surface of the grommet reducing the compressing applied to it compared with state of the art grommets. This extends the lifetime of the grommet and again, a cheaper material or a thinner grommet can be used.

Preferred valves are tilting valves and gun valves, wherein the central stem bore is in fluid communication with the interface between the valve stem base and the grommet flange via at least one lateral opening, so that the valve can be actuated by tilting or pushing down, respectively, the valve stem, which disrupts the seal at the interface between the valve stem base and the grommet flange to bring the interior of the container in fluid communication with the stem central bore and with ambient.

It is preferred that the edge of the cup opening is rounded, in order to reduce the wear of the grommet during use at said location. In a preferred embodiment, the cup comprises a substantially flat section between the annular fold and the peripheral edge so as to increase the volume to height ratio of the container, and thus spare some material. For the same reason, it is preferred that the lower surface of the stem base is substantially flat.

In yet another embodiment, the cup further comprises a second annular fold adjacent and concentric with the first annular fold, forming a rib in the first, inner surface and a groove in the second, outer surface, and the upper surface of the flange portion of the grommet preferably mates the geometry of said second fold too. This geometry allows to further stiffen the cup and to further stabilize the grommet.

The valve stem and grommets ran be produced separately, typically by injection moulding, and assembled in a subsequent assembling step. Alternatively, the valve stem and grommet are produced by an injection over injection moulding process, preferably, the grommet being injected over the valve stem as described e.g., in WO9617795. Production rates can be increased and seal between cup and grommet can be enhanced if the grommet is injection moulded over the cup.

The grommet can be made of neoprene, as is usual in such kind of valves, but in view of the structural advantages yielded by the specific geometry of the valve of the present invention, less performing materials, such as thermoplastic elastomers (TPE) can be used instead, thus reducing substantially the cost of production. Similarly the cup can be made of stainless steel or aluminium, but thinner that state of the art cups, or using lower grades steels or coated metals, such as tin coated steel.

The present invention also concerns a pressurized container containing a liquid to be dispensed, comprising a valve as defined supra. The valve of the present invention is most suitable for container, wherein the liquid to be dispensed is a moisture reactive composition, and is preferably a polyurethane foam. The container should be suitable for working at internal pressures of up to 14 bar, and should safely resist at least 18 bar, preferably at least 20 bar, as could be encountered if the container is exposed to a source of heat.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
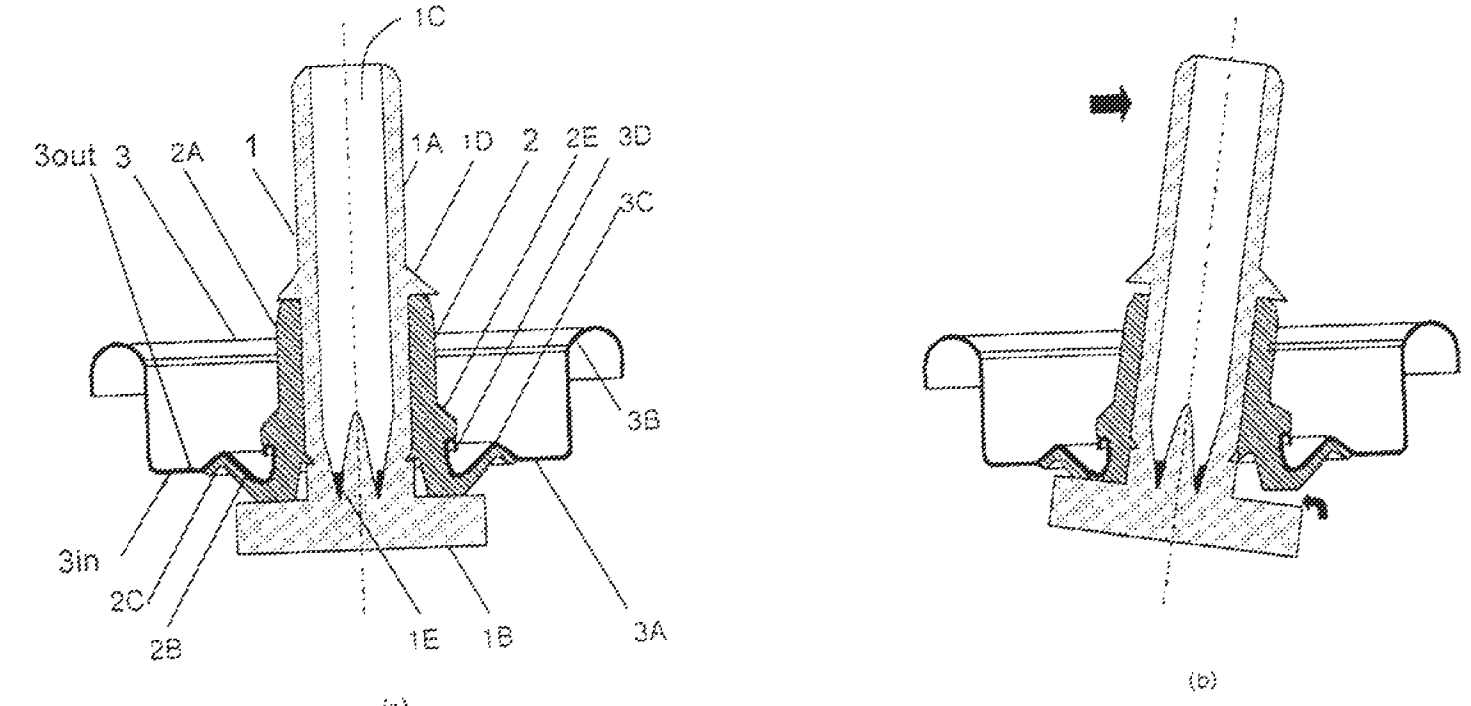
FIG. 1: shows a tilt valve according to the present invention (a) in closed position, and (b) in open position.
Figure 2:
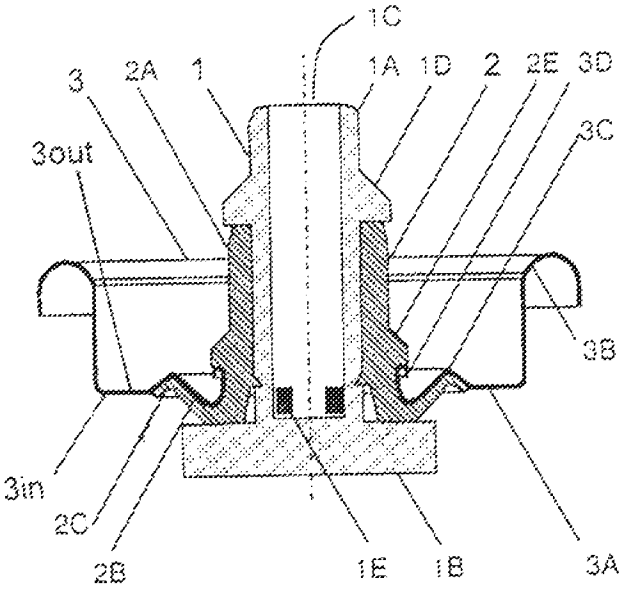
FIG. 2: shows a gun valve according to the present invention (a) in closed position, and (b) in open position.
Figure 2:
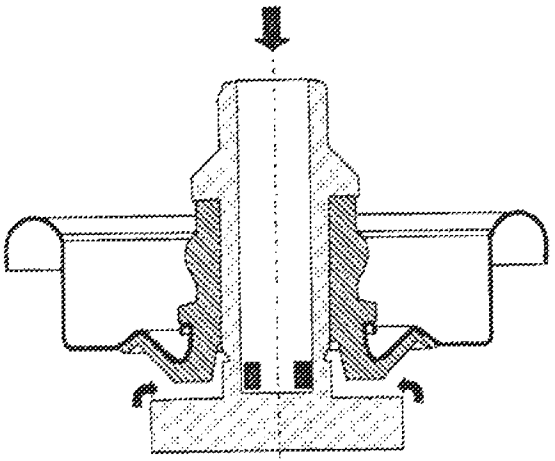

The present invention concerns a valve, preferably a tilt valve or a gun valve. Preferably the valve is used for dispensing a moisture reactive liquid composition, such as one or two component polyurethane foam compositions. As illustrated in the embodiments of FIGS. 1 and 2, a valve of the present invention is of the type comprising:

(a) Valve Cup (3)

Figure 4:
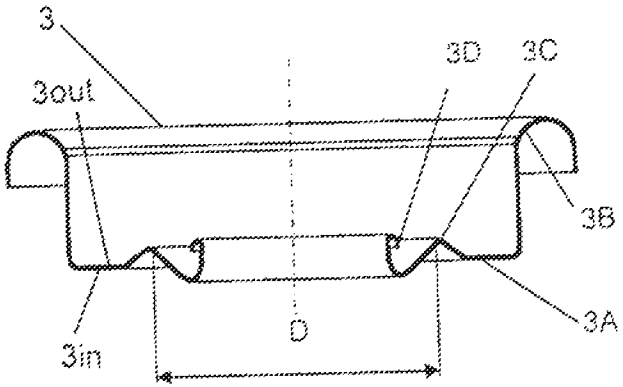
FIG. 4: shows a cup according to the present invention.

The valve of the present invention comprises a cup (3) for tightly closing the container. The cup is made of a thin, generally circular, plate comprising a first, inner surface (3in) and a second, outer surface (3out). The cup comprises a substantially planar central portion and a peripheral edge (3B). The peripheral edge (3B) of the cup is suitable for sealingly fixing to the top opening of a container. A through opening is provided substantially at the centre of the cup's central portion. As illustrated in FIG. 4, the cup of a valve according to the present invention further comprises a first annular fold (3C) of diameter, D, forming a groove in the first, inner surface (3in) and a rib in the second, outer surface (3out). The annular fold (3C) is preferably concentric with the cup opening, which edge is preferably rounded for reasons explained below. The first annular fold preferably has a depth comprised between 1.0 and 5.0 mm, more preferably between 1.5 and 2.5 mm, and most preferably, the fold is 1.8±0.3 mm. In order to reduce stress concentrations at the level of the fold, it should preferably not comprise any edges having a radius of curvature lower than 0.1 mm, preferably not lower than 0.2 mm.

This annular fold already has the advantage of stiffening the plate. It follows that a thinner plate can be used to resist the internal pressure of the container or, alternatively, a less performing, and cheaper material can be used for the cup. For example a stainless steel cup according to the present invention can be thinner than conventional cups. Alternatively, aluminium can be used or a lower grade steel or other material, possibly coated against oxidation and for aesthetic reasons, such as a steel plate coated with tin.

Figure 3:
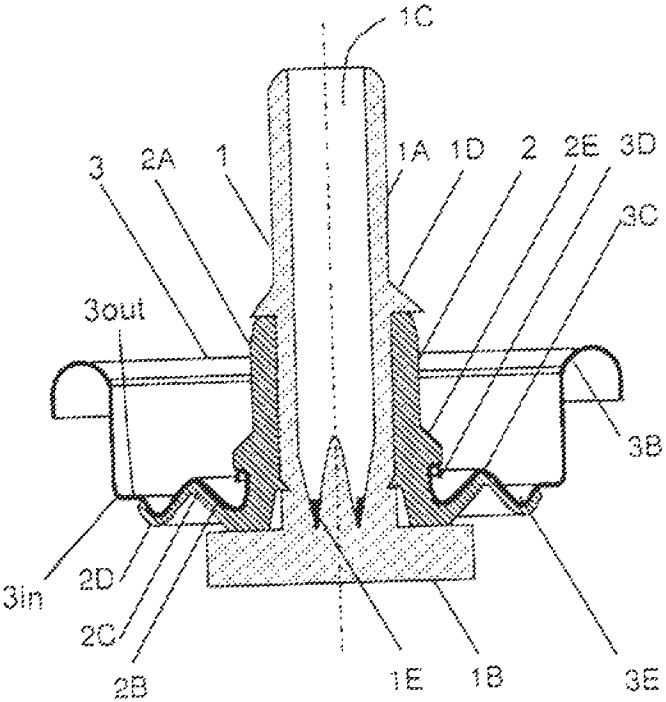
FIG. 3: shows another embodiment of a tilt valve according to the present invention.

In a preferred embodiment illustrated in FIG. 3, the cup (3) can comprise a second annular fold (3D), substantially concentric with the first fold (3C), the second annular fold (3D) forming a rib in the first, inner surface (3in) and a groove in the second, outer surface (3out). The cup (3) is further stiffened by this second annular fold (3D), and the thickness of the cup plate can be correspondingly reduced.

In an alternative embodiment, the cup comprises a second fold concentric with the first fold (3C), and having the same orientation as the latter, i.e., forming a rib on the outer surface (3out) and a groove in the inner surface (3in), the two folds being separated by a substantially planar section (3A).

In order to reduce the ratio of the height to the volume of the container, H/V, it is preferred that the cup (3) comprises a substantially flat section (3A) between the outer annular fold (3C, 3D) and the peripheral edge (3B), so as to not intrude deep into the volume of the container. This allows considerable savings in metal for the container. For example, if the height of a can of diameter 8 cm can be reduced by 1 cm, yields a saving of little more than 1250 $m^2$ material for a production of one million cans.

(b) Grommet (2)

The valve of the present invention comprises a grommet (2) made of a resilient material such as an elastomer, and extending on both sides of the cup through the cup opening. The grommet has a hollow tubular portion (2A) defining a central through bore, and at a first end facing the interior of the container it comprises an annular flange portion (2B) of diameter greater than D, which upper surface seals against the first, inner surface (3in) of the cup (3). The rounded edge of the cup through opening is advantageous in that it reduces substantially wear of the grommet (2) against said edge upon use of the valve.

According to the present invention, the upper surface of the flange portion (2B) of the grommet mates the geometry of the first, inner surface (3in) of the cup (3) including the portion (2C) of the grommet mating the groove formed by the fold (3C). This geometry enhances substantially the stability of the grommet upon use, in particular for tilting valves as illustrated in FIG. 1(*b*). Indeed, the flange of the grommet cannot slip with respect to the cup inner surface upon tilting the valve as it is firmly retained by the groove. The present geometry is advantageous over grommets designs as proposed in U.S. Pat. No. 5,762,319, US2010/147897, or U.S. Pat. No. 5,014,887 in that no vertical peripheral wall is required while retaining nonetheless a high stability. This has two advantages: first it permits to save a substantial amount of material which, multiplied by the production volume, can represent substantial savings. Second, while the grommet of the present invention can still be moulded over the cup like the grommets disclosed in the foregoing documents, contrary to them, it can also be assembled to the cup.

The grommet (2) can be made of any elastomer having the required mechanical and chemical resistance, such as neoprene. As will be seen in continuation, lower grade elastomeric materials can be used as upon use, the grommet is not so much strained in compression as in more traditional valve designs. Typically, it is possible to produce high quality valves with a grommet made of thermoplastic elastomer (TPE) with viscoelastic properties much lower than neoprene.

In the embodiment illustrated in FIG. 3 comprising a first and second annular folds (3C, 3E), it is preferred that the upper surface of the flange portion (2B) of the grommet mates the geometry of said second fold (3E) too. This embodiment yields a grommet with very high stability.

(c) Valve Stem (1)

A valve stem (1) comprising a hollow tubular portion (1A) defining a central bore (1C), said valve stem snugly fitting in the grommet central bore, and extending on both sides of the grommet (2), with a first end opening to ambient and a second, opposite end being closed by an end base (1B) of diameter greater than the diameter of the bore of the grommet (2), wherein the upper surface of the base (1B) is suitable for sealing against the lower surface of the grommet flange (2B);

Again, in order to decrease the ratio height to volume of the container, H/V, it is preferred that the lower surface of the stem base (1B) is substantially flat. The same advantages as discussed with respect to the flat portion of the cup (3) discussed supra apply mutatis mutandis to the bottom surface of the valve stem.

The central bore (1C) of the valve stem is preferably in fluid communication with the interface between the valve stem base (1B) and the grommet flange (2B) via at least one lateral opening (1E), so that the valve can be actuated by tilting or pushing down the valve stem (1), which disrupts the seal at the interface between the valve stem base (1B) and the grommet flange (2B) to bring the interior of the container in fluid communication with the stem central bore (1C) and with ambient. When the valve is actuated by tilting it, it is referred to as a tilting valve, as illustrated in FIGS. 1(*a*)&(*b*). On the other hand, when the valve is actuated by pushing down (i.e., towards the interior of the container) the valve stem, it is referred to as a gun valve as illustrated in FIGS. 2(*a*)&(*b*).

At rest, the valve when mounted on a pressure vessel such as an aerosol can, is gas tight. All interfaces between grommet and cup, and between grommet and valve stem are sealed. The internal pressure of the container ensures that the base (1B) of the valve stem is pressed tight against the lower surface of the flange (2B) of the grommet. Upon tilting the valve stem, the grommet is bent as illustrated in FIG. 1(B) and the seal between the base (1B) of the valve stem and the lower surface of the flange (2B) of the grommet is disrupted allowing the liquid contained in the container to flow out through the stem openings (1E) and through the bore (1C) to reach ambient at the valve stem outlet. One great advantage of the geometry of a tilting valve according to the present invention, is that the upper surface of the base (1B) of the valve stem slips to a certain extent round the first rib formed by the grommet flange just before extending into the cup groove (3C). In conventional designs, no such slippage is allowed, and one side of the grommet flange is severely compressed by the tilting base of the valve stem. For this reason, only material with a highly elastic components such as neoprene can be used in traditional tilting valves, as after the compressive stress is released, the elastomer must recover most of its thickness. In tilting valves according to the present invention, the compressive stress during use is substantially reduced thanks to this rolling/slipping movement of the valve stem base about the grommet flange (2B). This allows materials with more viscous behaviour to be used, and opens up the possibility of a whole range of elastomeric materials, traditionally considered as not suitable for use in a tilting valve.

The valve of the present invention can be produced by producing separately a valve stem (1), a grommet (2), and a cup (3) and assembling these parts in a separate assembling step. Alternatively, the valve stem (1) and grommet (2) can be produced by an injection over injection moulding process, preferably, the grommet (2) being injected over the valve stem (1). In yet another embodiment, the grommet (2) can be injection moulded over the cup in order to ensure a tight interface between cup and grommet, in particular over the groove region (3C). These over-injection techniques can be advantageous in that they spare a time consuming assembly step and ensures optimal interfaces between the elements. The equipment required is, however, more expensive. The valve of the present invention permits to make a rather flat design of the cup which is less intrusive than valves as disclosed in, e.g., U.S. Pat. No. 5,762,319, US2010/147897, and U.S. Pat. No. 5,014,887

The present invention also concerns a pressurized container containing a liquid to be dispensed, comprising a valve as described supra. In particular, the container should be suitable for working at internal pressures of up to 14 bar, and can safely resist at least 18 bar, preferably at least 20 bar. This requirement is essential for safety reasons, since the pressure inside the container can rise very quickly if exposed to a heat source.

The liquid contained in a container according to the present invention is preferably a moisture reactive composition, such as a polyurethane foam, preferably a one component polyurethane foam composition.

The invention claimed is:

1. A valve for a pressurized dispensing container suitable for dispensing a polyurethane foam, comprising:

(a) A valve cup comprising a substantially planar central portion, and a peripheral edge suitable for sealingly fixing the cup to the top opening of a container and thus tightly closing the container, said cup being made of a thin plate comprising a first, inner surface and a second, outer surface, wherein the central portion comprises a through opening surrounded by a first triangular annular fold of diameter, D, forming a groove in the first, inner surface and a rib in the second, outer surface of the substantially planar central portion; wherein the portion of the valve cup having a diameter less than D extends a distance further along a vertical axis away from the peripheral edge than the portion of the valve cup having a diameter greater than D;

(b) A resilient grommet extending on both sides of the cup through the cup opening, said grommet having a hollow tubular portion defining a central bore, and at a first end facing the interior of the container it comprises an annular flange portion of diameter greater than D, which upper surface seals against the first, inner surface of the cup's substantially planar central portion, (c) A valve stem comprising a hollow tubular portion defining a central bore, said valve stem snugly fitting in the grommet central bore, and extending on both sides of the grommet, with a first end opening to ambient and a second, opposite end being closed by a circular end base of diameter greater than the diameter of the bore of the grommet, wherein the upper surface of the base is suitable for sealing against the lower surface of the grommet flange;

wherein the upper surface of the flange portion of the grommet mates the geometry of the first, inner surface of the cup's substantially planar central portion including a triangular portion of the grommet mating the groove formed by the triangular fold and wherein the grommet is made of neoprene or preferably of a thermoplastic elastomer.

2. The valve according to claim 1, wherein the edge of the cup opening is rounded.

3. The valve according to claim 2, wherein the central stem bore is in fluid communication with the interface between the valve stem base and the grommet flange via at least one lateral opening, so that the valve can be actuated by tilting or pushing down the valve stem which disrupts the seal at the interface between the valve stem base and the grommet flange to bring the interior of the container in fluid communication with the stem central bore and with ambient.

4. The valve according to claim 3, wherein the cup comprises a substantially flat section between the annular fold and the peripheral edge.

5. The valve according to claim 4, wherein the lower surface of the stem base is substantially flat.

6. The valve according to claim 5, wherein the cup further comprises a second annular fold adjacent the first, forming a rib in the first, inner surface and a groove in the second, outer surface.

7. The valve according to claim 6, wherein grommet is produced by an injection over injection moulding process, preferably, the grommet being injected over the valve stem.

8. The valve according to claim 7, wherein the grommet is injection moulded over the cup.

9. The valve according to claim 7 wherein the cup is made of steel, stainless steel, aluminum, or a coated metal, such as tin coated steel.

10. A pressurized container containing a liquid to be dispensed, comprising a valve according to claim 1.

11. The pressurized container according to claim 10, wherein the liquid to be dispensed is a moisture reactive composition, and is preferably a polyurethane foam.

12. The pressurized container according to claim 11, suitable for working at internal pressures of up to 14 bar, and can safely resist at least 18 bar.

13. The pressurized container according to claim 10, suitable for working at internal pressures of up to 14 bar, and can safely resist at least 18 bar.

14. The valve according to claim 1, wherein the central stem bore is in fluid communication with the interface between the valve stem base and the grommet flange via at least one lateral opening, so that the valve can be actuated by tilting or pushing down the valve stem which disrupts the seal at the interface between the valve stem base and the grommet flange to bring the interior of the container in fluid communication with the stem central bore and with ambient.

15. The valve according to claim 1, wherein the cup comprises a substantially flat section between the annular fold and the peripheral edge.

16. The valve according to claim 1, wherein the lower surface of the stem base is substantially flat.

17. The valve according to claim 1, wherein the cup further comprises a second annular fold adjacent the first, forming a rib in the first, inner surface and a groove in the second, outer surface.

18. The valve according to claim 1, wherein grommet is produced by an injection over injection moulding process, preferably, the grommet being injected over the valve stem.

19. The valve according to claim 1, wherein the grommet is injection moulded over the cup.

20. The valve according to claim 6, wherein the flange portion of the grommet preferably mates the geometry of said second fold.

* * * * *